United States Patent [19]

DeCristofaro et al.

[11] 4,298,409

[45] * Nov. 3, 1981

[54] METHOD FOR MAKING IRON-METALLOID AMORPHOUS ALLOYS FOR ELECTROMAGNETIC DEVICES

[75] Inventors: Nicholas J. DeCristofaro, Chatham; Alfred Freilich, Livingston; Davidson M. Nathasingh, Stanhope, all of N.J.

[73] Assignee: Allied Chemical Corporation, Morris Township, Morris County, N.J.

[ * ] Notice: The portion of the term of this patent subsequent to Aug. 26, 1997, has been disclaimed.

[21] Appl. No.: 133,774

[22] Filed: Mar. 25, 1980

Related U.S. Application Data

[60] Continuation-in-part of Ser. No. 101,934, Dec. 10, 1979, Pat. No. 4,249,969, which is a division of Ser. No. 42,472, May 25, 1979, Pat. No. 4,219,335.

[51] Int. Cl.[3] ..... H21D 1/04

[52] U.S. Cl. ..... 148/108; 148/103; 148/121; 148/31.50; 148/31.55; 148/31.57; 75/123 B; 75/123 L

[58] Field of Search ..... 148/103, 27, 108, 28, 148/31.55, 31.57, 31.50, 121; 75/123 B, 123 L

[56] References Cited

U.S. PATENT DOCUMENTS

| | | | |
|---|---|---|---|
| 3,178,321 | 4/1965 | Satterfield | 148/28 |
| 3,522,108 | 7/1970 | Yamamoto et al. | 148/28 |
| 3,856,513 | 12/1974 | Chen et al. | 75/122 |
| 4,096,000 | 6/1978 | Wada et al. | 148/27 |
| 4,116,728 | 9/1978 | Becker et al. | 148/108 |
| 4,130,447 | 12/1978 | Marianeschi et al. | 148/27 |
| 4,219,355 | 8/1980 | DeCristofaro et al. | 75/123 B |
| 4,249,969 | 2/1981 | DeCristofaro et al. | 148/121 |

*Primary Examiner*—L. Dewayne Rutledge
*Assistant Examiner*—John P. Sheehan
*Attorney, Agent, or Firm*—Ernest D. Buff; Gerhard H. Fuchs

[57] ABSTRACT

An amorphous metal alloy which is at least 90 percent amorphous and consists essentially of a composition having the formula $Fe_aB_bSi_cC_d$ wherein "a", "b", "c" and "d" are atomic percentages ranging from about 80.0 to 82.0, 12.5 to 14.5, 2.5 to 5.0 and 1.5 to 2.5, respectively, with the proviso that the sum of "a", "b", "c" and "d" equals 100, is annealed at a temperature ranging from 380°–410° C. The resulting alloy has decreased high frequency core losses and increased low field permeability; is particularly suited for high frequency applications.

7 Claims, No Drawings

METHOD FOR MAKING IRON-METALLOID AMORPHOUS ALLOYS FOR ELECTROMAGNETIC DEVICES

DESCRIPTION

This is a continuation-in-part of U.S. application Ser. No. 101,934, filed Dec. 10, 1979, now U.S. Pat. No. 4,249,969 which, in turn, is a divisional of U.S. application Ser. No. 042,472, filed May 25, 1979, now U.S. Pat. No. 4,219,335.

BACKGROUND OF THE INVENTION

1. Field of the Invention

The invention relates to amorphous metal alloy compositions and, in particular, to amorphous alloys containing iron, boron, silicon and carbon having enhanced dc and ac magnetic properties.

2. Description of the Prior Art

Investigations have demonstrated that it is possible to obtain solid amorphous materials from certain metal alloy compositions. An amorphous material substantially lacks any long range atomic order and is characterized by an X-ray diffraction profile consisting of broad intensity maxima. Such a profile is qualitatively similar to the diffraction profile of a liquid or ordinary window glass. This is in contrast to a crystalline material which produces a diffraction profile consisting of sharp, narrow intensity maxima.

These amorphous materials exist in a metastable state. Upon heating to a sufficiently high temperature, they crystallize with evolution of the heat of crystallization, and the X-ray diffraction profile changes from one having amorphous characteristics to one having crystalline characteristics.

Novel amorphous metal alloys have been disclosed by H. S. Chen and D. E. Polk in U.S. Pat. No. 3,856,513, issued Dec. 24, 1974. These amorphous alloys have the formula $M_aY_bZ_c$ where M is at least one metal selected from the group of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, "a" ranges from about 60 to 90 atom percent, "b" ranges from about 10 to 30 atom percent and "c" ranges from about 0.1 to 15 atom percent. These amorphous alloys have been found suitable for a wide variety of applications in the form of ribbon, sheet, wire, powder, etc. The Chen and Polk patent also discloses amorphous alloys having the formula $T_iX_j$, where T is at least one transition metal, X is at least one element selected from the group consisting of aluminum, antimony, beryllium, boron, germanium, carbon, indium, phosphorus, silicon and tin, "i" ranges from about 70 to 87 atom percent and "j" ranges from about 13 to 30 atom percent. These amorphous alloys have been found suitable for wire applications.

At the time that the amorphous alloys described above were discovered, they evidenced magnetic properties that were superior to then known polycrystalline alloys. Nevertheless, new applications requiring improved magnetic properties and higher thermal stability have necessitated efforts to develop additional alloy compositions.

SUMMARY OF THE INVENTION

In accordance with the present invention, there is provided a method of enhancing the magnetic properties of a metal alloy which is at least 90 percent amorphous and consists essentially of a composition having the formula $Fe_aB_bSi_cC_d$ wherein "a", "b", "c" and "d" are atomic percentages ranging from about 80.0 to 82.0, 12.5 to 14.5, 2.5 to 5.0 and 1.5 to 2.5, respectively, with the proviso that the sum of "a", "b", "c" and "d" equals 100, which method comprises the step of annealing the amorphous metal alloy at a temperature ranging from about 380°–410° C.

Further, the invention provides a method of enhancing magnetic properties of the alloy set forth above, which method the steps of (a) quenching a melt of the alloy at a rate of about $10^{5°}$ to $10^{6°}$ C./sec to form said alloy into continuous ribbon; (b) coating said ribbon with magnesium oxide; (c) annealing said coated ribbon at a temperature ranging from about 380°–410° C.

Alloys produced in accordance with the method of this invention are at least 90 percent amorphous and preferably at least 97 percent amorphous, and most preferably nearly 100 percent amorphous, as determined by X-ray diffraction.

Alloys produced by the method of this invention exhibit improved ac and dc magnetic properties that remain stable at temperatures up to about 150° C. As a result, the alloys are particularly suited for use in power transformers, aircraft transformers, current transformers, 400 Hz transformers, switch cores, high gain magnetic amplifiers and low frequency inverters.

DETAILED DESCRIPTION OF THE INVENTION

The composition of the new amorphous Fe-B-Si-C alloy, in accordance with the invention, consists of 80 to 82 atom percent iron, 12.5 to 14.5 atom percent boron, 2.5 to 5.0 atom percent silicon and 1.5 to 2.5 atom percent carbon. Such compositions exhibit enhanced dc and ac magnetic properties. The improved magnetic properties are evidenced by high magnetization, low core loss and low volt-ampere demand. A preferred composition within the foregoing ranges consists of 81 atom percent iron, 13.5 atom percent boron, 3.5 atom percent silicon and 2 atom percent carbon.

Alloys treated by the method of the present invention are at least about 90 percent amorphous and preferably at least about 97 percent amorphous and most preferably nearly 100 percent amorphous. Magnetic properties are improved in alloys possessing a greater volume percent of amorphous material. The volume percent of amorphous material is conveniently determined by X-ray diffraction.

The amorphous metal alloys are formed by cooling a melt at a rate of about $10^{5°}$ to $10^{6°}$ C./sec. The purity of all materials is that found in normal commercial practice. A variety of techniques are available for fabricating splat-quenched foils and rapid-quenched continuous ribbons, wire, sheet, etc. Typically, a particular composition is selected, powders or granules of the requisite elements (or of materials that decompose to form the elements, such as ferroboron, ferrosilicon, etc.) in the desired proportions are melted and homogenized, and the molten alloy is rapidly quenched on a chill surface, such as a rotating cylinder.

Alloys processed by the method of the present invention have an improved processability as compared to other iron-based metallic glasses, since the subject alloys demonstrate a minimized melting point and maximized undercooling.

The magnetic properties of the subject alloys can be enhanced by annealing the alloys. The method of annealing generally comprises heating the alloy to a temperature ranging from about 380°-410° C., cooling the alloy, and applying a magnetic field to the alloy during the heating and cooling. Generally, a temperature range of about 380° C. to 410° C. is employed during heating, with temperatures of about 385° C. to 395° C. being preferred. A rate of cooling range of about 0.5° C./min to 75° C./min is employed, with a rate of about 1° C./min to 16° C./min being preferred.

It has been discovered that the alloys of this invention exhibit magnetic properties especially suited for high frequency applications when annealed at temperatures ranging from about 380° to 410° C. Under such annealing conditions, the hysteresis loop is rounded, the low field permeability is increased and high frequency core losses are reduced. For example, the high frequency core losses for round loop material are approximately one-half the magnitude of those found in square loop material. Lower core losses result in less heat buildup and permit use of less core material and a higher induction level for a given operating temperature. Toroids constructed from alloys of the present invention annealed at temperatures of about 380° to 410° C. can be operated at a 50 percent higher induction level than those constructed from permalloy and ferrite material, yet require only two-thirds the core cross-sectional area thereof. Such smaller cross-sectional area, in turn, reduces the amount of copper to construct a magnetic device incorporating the core, and lowers copper losses. An additional 20 percent reduction in core losses exhibited by annealing the present alloys at a temperature of about 380°-410° C. can be obtained if, prior to the annealing step, the alloy is coated with magnesium oxide.

Applications wherein low core losses are particularly advantageous include energy storage inductors, pulse transformers, transformers that switch mode power supplies, current transformers and the like.

As discussed above, alloys annealed by the method of the present invention exhibit improved magnetic properties that are stable at temperatures up to about 150° C., rather than a maximum of 125° C. as evidenced by prior art alloys. The increased temperature stability of the present alloys allows utilization thereof in high temperature applications, such as cores in transformers for distributing electrical power to residential and commercial consumers.

When cores comprising the subject alloys are utilized in electromagnetic devices, such as transformers, they evidence high magnetization, low core loss and low volt-ampere demand, thus resulting in more efficient operation, of the electromagnetic device. The loss of energy in a magnetic core as the result of eddy currents, which circulate through the core, results in the dissipation of energy in the form of heat. Cores made from the subject alloys require less electrical energy for operation and produce less heat. In applications where cooling apparatus is required to cool the transformer cores, such as transformers in aircraft and large power transformers, an additional savings is realized since less cooling apparatus is required to remove the smaller amount of heat generated by cores made from the subject alloys. In addition, the high magnetization and high efficiency of cores made from the subject alloys result in cores of reduced weight for a given capacity rating.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES

Toroidal test samples were prepared by winding approximately 0.030 kg of 0.0254 m wide alloy ribbon of various compositions containing iron, boron, silicon and carbon on a steatite core having inside and outside diameters of 0.0397 m and 0.0445 m, respectively. One hundred and fifty turns of high temperature magnetic wire were wound on the toroid to provide a dc circumferential field of 795.8 ampere/meter for annealing purposes. The samples were annealed in an inert gas atmosphere for 2 hours at 365° C. with the 795.8 A/m field applied during heating and cooling. The samples were cooled at rates of 1° C./min and 16° C./min.

The dc magnetic properties, i.e., coercive force ($H_c$) and remanent magnetization at zero A/m ($B_{(0)}$) and at eighty A/m ($B_{(80)}$), of the samples were measured by a hysteresisgraph. The ac magnetic properties, i.e., core loss (watts/kilogram) and RMS volt-ampere demand (RMS volt-amperes/kilogram), of the samples were measured at a frequency of 60 Hz and a magnetic intensity of 1.26 tesla by the sine-flux method.

Field annealed dc and ac magnetic values for a variety of alloy compositions that are within the scope of the present invention are shown in Table I.

TABLE I

FIELD ANNEALED DC AND AC MAGNETIC MEASUREMENTS FOR AMORPHOUS METAL ALLOYS WITHIN THE SCOPE OF THE INVENTION

| Example | Composition Fe | B | Si | C | DC $H_c$ (A/m) | $B_{(0)}$ (T) | $B_{(80)}$ (T) | AC w/kg | 60 Hz 1.26T VA/kg |
|---|---|---|---|---|---|---|---|---|---|
| 1 at % | 81.0 | 13.0 | 4.0 | 2.0 | 4.0 | 1.40 | 1.56 | 0.19 | 0.29 |
| wt % | 94.2 | 2.9 | 2.4 | 0.5 | | | | | |
| 2 at % | 80.8 | 12.8 | 4.2 | 2.2 | 4.0 | 1.40 | 1.54 | 0.22 | 0.29 |
| wt % | 94.0 | 2.9 | 2.5 | 0.6 | | | | | |
| 3 at % | 80.1 | 13.3 | 4.6 | 2.0 | 3.2 | 1.38 | 1.52 | 0.31 | 0.35 |
| wt % | 93.8 | 3.0 | 2.7 | 0.5 | | | | | |
| 4 at % | 80.5 | 14.3 | 2.7 | 2.5 | 3.2 | 1.26 | 1.46 | 0.32 | 0.79 |
| wt % | 94.5 | 3.3 | 1.6 | 0.6 | | | | | |
| 5 at % | 81.0 | 13.2 | 3.9 | 1.9 | 4.8 | 1.22 | 1.48 | 0.24 | 0.79 |
| wt % | 94.2 | 3.0 | 2.3 | 0.5 | | | | | |
| 6 at % | 81.9 | 13.7 | 2.7 | 1.7 | 7.2 | 1.20 | 1.52 | 0.24 | 0.29 |
| wt % | 94.9 | 3.1 | 1.6 | 0.4 | | | | | |
| 7 at % | 81.0 | 13.5 | 3.5 | 2.0 | 3.2 | 1.46 | 1.53 | 0.19 | 0.25 |
| wt % | 94.5 | 3.0 | 2.0 | 0.5 | | | | | |

For comparison, the compositions of some amorphous metal alloys lying outside the scope of the invention and their field annealed dc and ac measurements are listed in Table II. These alloys, in contrast to those within the scope of the present invention, evidenced low magnetization, high core loss and high volt-ampere demand.

TABLE II

FIELD ANNEALED DC AND AC MAGNETIC MEASUREMENTS FOR AMORPHOUS METAL ALLOYS NOT WITHIN THE SCOPE OF THE INVENTION

| Example | Composition Fe | B | Si | C | DC $H_c$ (A/m) | $B_{(0)}$ (T) | $B_{(80)}$ (T) | AC w/ kg | 60 Hz 1.26T VA/kg |
|---|---|---|---|---|---|---|---|---|---|
| 8 at % | 81.0 | 12.0 | 6.0 | 1.0 | 4.8 | 0.98 | 1.27 | 0.29 | 3.53 |
| wt % | 93.6 | 2.7 | 3.5 | 0.2 | | | | | |
| 9 at % | 80.0 | 10.0 | 5.0 | 5.0 | 4.8 | 0.78 | 0.96 | 0.35 | 5.28 |
| wt % | 93.5 | 2.3 | 2.9 | 1.3 | | | | | |
| 10 at % | 83.3 | 12.3 | 2.6 | 1.8 | 18.4 | 0.07 | 0.28 | 0.73 | 22.22 |
| wt % | 95.3 | 2.8 | 1.5 | 0.4 | | | | | |
| 11 at % | 83.5 | 13.5 | 0.8 | 2.2 | 11.2 | 0.20 | 0.60 | 0.35 | 11.31 |
| wt % | 96.0 | 3.0 | 0.5 | 0.5 | | | | | |
| 12 at % | 77.5 | 12.0 | 8.3 | 2.2 | 4.8 | 1.06 | 1.30 | 0.24 | 1.47 |
| wt % | 91.7 | 2.8 | 4.9 | 0.6 | | | | | |
| 13 at % | 82.0 | 15.0 | 3.0 | 0.0 | 4.0 | 0.62 | 0.97 | 0.33 | 3.30 |
| wt % | 94.9 | 3.4 | 1.7 | 0.0 | | | | | |

Toroidal test samples (hereafter designated Examples 14–23) were prepared in accordance with the same procedure set forth in Example 7 except that the annealing step was conducted at a temperature ranging from 365° to 420° C.

Core loss and exciting power values for this alloy at 50 kHz and 0.1T are set forth in Table III as a function of annealing temperatures:

TABLE III

| Example | Composition | Annealing Temp. | Core Loss at 50 kHz .1T w/kg | Exciting Power at 50 Hz .1T VA/kg |
|---|---|---|---|---|
| 14 | $Fe_{81}B_{13.5}Si_{3.5}C_2$ | 365 | 14 | 43 |
| 15 | " | 380 | 10 | 33 |
| 16 | " | 385 | 8 | 28 |
| 17 | " | 390 | 8 | 23 |
| 18 | " | 395 | 8 | 34 |
| 19 | " | 400 | 7 | 43 |
| 20 | " | 405 | 7 | 53 |
| 21 | " | 410 | 9 | 61 |
| 22 | " | 415 | 9 | 66 |
| 23 | " | 420 | 11 | 86 |

Toroidal test samples were prepared in accordance with the same procedure set forth in Examples 14–23 except that the alloy ribbon used therein was coated with magnesium oxide (MgO). The ribbon was coated by pulling the ribbon through a bath of magnesium methylate (8% in solution MgO). Thereafter the ribbon was fed through a pair of rollers to remove any excess coating. Before the ribbon reached a take-up spool (usually 0.6096 meters away from final roller) the methanol solution evaporated leaving a thin film of magnesium oxide on the ribbon. The ribbon was then removed from the take-up spool to make the test samples.

Core loss and exciting power values for these samples at 50 kHz and 0.1T are set forth in Table IV as a function of annealing temperatures:

TABLE IV

| Example | Composition of Ribbon Coated With MgO | Annealing Temp. | Core Loss at 50 kHz .1T w/kg | Exciting Power at 50 Hz .1T VA/kg |
|---|---|---|---|---|
| 24 | $Fe_{81}B_{13.5}Si_{3.5}C_2$ | 365 | 13 | 41 |
| 25 | " | 380 | 9 | 30 |
| 26 | " | 385 | 7 | 29 |
| 27 | " | 390 | 6 | 18 |
| 28 | " | 395 | 6 | 27 |
| 29 | " | 400 | 7 | 36 |
| 30 | " | 405 | 8 | 47 |
| 31 | " | 410 | 9 | 53 |
| 32 | " | 415 | 10 | 58 |
| 33 | " | 420 | 10 | 73 |

We claim:

1. A method of enhancing the magnetic properties of a metal alloy which is at least 90 percent amorphous and consisting essentially of a composition having the formula $Fe_aB_bSi_cC_d$ wherein "a", "b", "c" and "d" are atomic percentages ranging from about 80.0 to 82.0, 12.5 to 14.5, 2.5 to 5.0 and 1.5 to 2.5, respectively, with the proviso that the sum of "a", "b", "c" and "d" equals 100, which method comprises the step of annealing said alloy at a temperature ranging from about 380°–410° C.

2. A method as recited in claim 1, wherein said annealing step further comprises:

(a) heating said alloy to a temperature sufficient to achieve stress relief;

(b) cooling said alloy at a rate of about 0.5° C./min to 75° C./min; and (c) applying a magnetic field to said alloy during said heating and cooling.

3. A method as recited in claim 1, wherein the annealing temperature for said alloy is about 390° C.

4. A method as recited in claim 1, wherein said annealing step comprises:

heating said alloy to a temperature in the range of about 380° C. to 410° C.;

cooling said alloy at a rate of about 1° C./min to 16° C./min; and applying a magnetic field to said alloy during said heating and cooling.

5. A product produced by the process of claim 1.

6. A method of enhancing the magnetic properties of a metal alloy which is at least 90 percent amorphous and consists essentially of a composition having the formula $Fe_aB_bSi_cC_d$ wherein "a", "b", "c" and "d" are atomic percentages ranging from about 80.0 to 82.0, 12.5 to 14.5, 2.5 to 5.0 and 1.5 to 2.5, respectively, with the proviso that the sum of "a", "b", "c" and "d" equals 100, which method comprises the steps of:

(a) quenching a melt of the alloy at a rate of about $10^{5}$° C. to $10^{6}$° C./sec to form said alloy into continuous ribbon;

(b) coating said ribbon with magnesium oxide; and (c) annealing said coated ribbon at a temperature ranging from about 380°–410° C.

7. A product produced by the process of claim 6.

* * * * *